US006423669B1

(12) United States Patent
Alexandrov et al.

(10) Patent No.: US 6,423,669 B1
(45) Date of Patent: Jul. 23, 2002

(54) COMPOSITION FOR THE TREATMENT OF FRICTION PAIRS

(75) Inventors: Sergei Nikolaevich Alexandrov, u1. 2-oi Pyatiletki 18-54, Kharkov, 61007; Vladimir Valentinovich Buzov, u1. Chaikovskogo 33b-53 Kharkov, 61024; Elmin Abbas-Ogli Gamidov, u1. Groznenskaya 56-39, Kharkov, 61124; Vladimir Leonidovich Zozulya, u1. Bakulina 1-9-10, Kharkov, 61054; Sergei Leonidovich Zozulya, u1. Sumgaitskaya 4-3, Kharkov, 61018, all of (UA)

(73) Assignees: Sergei Nikolaevich Alexandrov; Elmin Abbas-Ogli Gamidov; Vladimir Leonidovich Zozulya; Sergei Leonidovich Zozulya, all of Kharkov (UA)

( * ) Notice: Subject to any disclaimer, the term of this patent is extended or adjusted under 35 U.S.C. 154(b) by 0 days.

(21) Appl. No.: 09/786,556

(22) PCT Filed: Jun. 2, 2000

(86) PCT No.: PCT/UA00/00017

§ 371 (c)(1),
(2), (4) Date: Mar. 2, 2001

(87) PCT Pub. No.: WO01/02520

PCT Pub. Date: Jan. 11, 2001

(30) Foreign Application Priority Data

Jul. 6, 1999 (UA) ..... 99073806

(51) Int. Cl.[7] ..... C10M 125/00; C10M 125/08

(52) U.S. Cl. ..... 508/161; 508/140; 508/148; 508/165; 508/170

(58) Field of Search ..... 508/161, 165, 508/170

(56) References Cited

U.S. PATENT DOCUMENTS 4,229,309 A * 10/1980 Cheng et al. ..... 252/25
4,336,148 A * 6/1982 Wirth et al. ..... 252/49.7
4,340,493 A * 7/1982 Miyata ..... 252/18
4,465,604 A * 8/1984 King ..... 252/37.2
5,037,563 A * 8/1991 Pink et al. ..... 252/18
5,308,515 A * 5/1994 Michlin et al. ..... 252/21
5,409,622 A * 4/1995 Chapman et al. ..... 252/25
5,468,400 A * 11/1995 Michlin ..... 252/21

FOREIGN PATENT DOCUMENTS

GB 499338 * 1/1939
GB 977366 * 12/1964
GB 1096458 * 12/1967
WO WO 92/18238 * 10/1992
WO WO 96/40849 * 12/1996
WO WO 01/02520 A1 * 1/2001

OTHER PUBLICATIONS

PCT/UA00/00017, International Search Report, Nov. 2000.*
Chemical Abstract RU2057257 (Kazarezov et al), 1996.*
Chemical Abstract SU1113403 (Chuiko et al), 1985.*

* cited by examiner

*Primary Examiner*—Ellen M. McAvoy
(74) *Attorney, Agent, or Firm*—Susan J. Friedman

(57) ABSTRACT

The present invention relates to the lubricant grease compositions, in particular to the compositions for the treatment of friction pairs, and can be used in the machine building for the treatment of friction units, and also during the exploitation of different mechanisms and machines for prolongation of interrepair time or for damage control (repair-restore operations). The basis of the invention is the improvement of the composition for the treatment of friction pairs, including metal and non-metal oxides, in which, as a consequence of the use of the products of dehydration of such hydrates, which in the stable state contain oxides from the series of MgO, $SiO_2$, $Al_2O_3$, CaO, $Fe_2O_3$, $K_2O$, $Na_2O$ in its composition, is provided by the formation of the stable state on nanodispersed oxide structures, which minimize the resistance to displacement and area of contact surfaces of friction pairs, and transfer any form of friction in the rolling friction, and at the expense of that, strengthening of friction pair surfaces and decrease of friction coefficient are reached; working-technical conditions of machines and mechanisms are improved. The use of the compositions according to the offered technical decision provides to receive the stable results, manifested by hardness and wear resistance increase, friction coefficient decrease, improving of technical-economical characteristics of the machines and mechanisms.

16 Claims, No Drawings

COMPOSITION FOR THE TREATMENT OF FRICTION PAIRS

The present invention relates to the lubricant grease compositions, in particular to the compositions for the treatment of friction pairs, and can be used in the machine building for the treatment of friction units, and also during the exploitation of different mechanisms and machines for prolongation of interrepair time or for damage control (repair-restore operations).

BACKGROUND OF THE INVENTION

It is known that the task of any lubricant grease is to prevent direct contact between the surfaces and, consequently, its local welding with the aim to decrease power inputs for destruction of "welding bridges" and to decrease wear taking place in the points of surface contacts of friction pairs.

At the absence of direct contact between rubbing metals friction force is defined by resistance of displacement of lubricant, true contact area and loading. Consequently, friction can be principally decreased by the correct lubricant selection.

It is known that there are solid lubricants [Klamann D. Lubricants and Related Products. M.: Khimiya, 1988, pp. 164–176] on the basis of graphite, molybdenum disulphide and the series of oxides providing the decrease of shear resistance as they have flaky structure, which provides formation of the so called "mirrors of sliding". They are used rather successfully simultaneously with mineral oils for the series of mechanisms and machines, and can be useful for providing "repair lubrication" for some time. However, it is not recommended to introduce solid lubricant in lubricating oil for severe conditions, as these oils consist of optimally balanced package of doped oil and solid lubricants can decrease these properties. Moreover, dispersion instability of solid greases leads to clogging of the oil circulation system, to "oil starving" and to jamming of metal details. It is necessary to note that the use of the mentioned solid greases does not provide the decrease of the friction coefficient below 0,01.

It is known that abrasive-like powder prepared out of natural serpentinite consisting of (in mass %) MgO, CaO-20–60, $SiO_2$, $Al_2O_3$-20–60, $H_2O$-3–10 and rock admixtures in quantity 3–10 [patent RU No.2006707, IC F 16 C 33/14, of 03.07.92] can be used as solid admixture. While using the powder it is suggest to make its mechanical activation at temperature 40–60° C.

The use of natural pyrophyllite as antiwear additive to lubricant grease [patent RU No. 1377284, IC C 10 M 125/26, of 20.02.86] is also known.

It is supposed that abrasive-like powders of the mentioned compositions are able to increase wear resistance of rubbing surfaces.

However, as practice shows, the use of the powders of the mentioned compositions in series of cases does not give a desirable result and leads to quite opposite effect; it increases wear of friction pair surfaces.

The use of a mixture of minerals containing (in mass %) SiO-30–40, MgO-20–35, $Fe_2O_3$-10–15, FeO-4–6, $Al_2O_3$-3–8, S-2–6, accompanying admixtures-5–30 is also known (patent RU No. 2,057,257, filed Mar. 21, 1994). As it is said in the patent, the initial treatment takes place at a temperature not less than 300° C. in a micro volume. It is the authors' opinion that the mixture of natural minerals such as serpentine, enstatite, magnetite, talc, ilmenite, amphibole, brimstone, biotite and petlantide in the form of a powder with particle size 0.01–1.0 mμ is the basis for the oxide composition described in the patent. As a result of the use of the aforementioned minerals in different proportions, depending on the natural source, the formation of ultra strong surfaces and decreased wear is observed on some friction pairs. The authors noted that it is possible to use a machine without lubricant grease in "testing units" for a long time.

The mixture of such a composition containing serpentine, talc, sulfur, pyrrotine, enstatite and fayalite is described in another patent (RU No. 2,035,636, filed Jul. 7, 1993). According to this description, the mixture was treated with dry saturated steam at a temperature of 110–115° C. before use in order to deprive of water and stabilize the dispersion. Such a method of treatment, in the authors' opinion, caused a decrease in the friction coefficient and stabilized the powder dispersion. The absence of figures in the invention description concerning dispersion, friction coefficient and other data gives evidence that the results obtained are not stable.

Moreover, concentrated lubricant product containing a mixture of hydroxides of nickel, zinc, copper, chromium in the proportion 1:1:1:1 based on the metal content, oleic acid and grease material is known (patent RU No. 2,016,050, filed Mar. 2, 1992). As is noted in the description, the use of the concentrated product reduces the grinding time in friction pairs and decreases wear 1.5–2 times.

However, the received results cannot be considered sufficient as the friction coefficient remains high (not lower than 0,061 and the use of oleic acid is a cause of corrosion phenomenon in friction pairs.

Patent RU No. 2,059,121 describes a composition for the treatment of friction pairs which comprises dehydrated powder containing (in mass %) MgO-39, $SiO_2$-36, FeO, $Fe_2O_2$, $Fe_3O_{4-10}$, $Al_2O_3$, rare-earth metals-1.3, oxides Mn, Ni, Co, Cu, Ti, Zr, Cr-3.5 and other admixtures—the rest. Any raw material containing natural serpentinite deposits can provide such a composition. The use of the above-mentioned powder mixture gave a 3% increase in efficiency and 7% decrease of reducer temperature, although no other advantages of the mixture and methods of its use were described.

Also, it should be noted that while different serpentinite compositions prepared as a finely dispersed powder undoubtedly can affect wear resistance of friction pairs, this effect is evidently not stable. In a number of cases the result obtained is quite opposite. Wear resistance not only increases but wear is noticeable, not only initially when it can increase 5–6× compared with the usual grinding effect. In addition, a decrease of friction coefficient does not occur.

SUMMARY OF THE INVENTION

The invention embodied in the present application provides an improved lubricating composition that reproducibly increases the wear resistance, reduces the friction coefficient and improves the operating characteristics of machines and equipment and their costs of operation.

The problem presented is solved according to the present invention by providing a defined stable composition for the treatment of friction pairs, which comprises metal and non-metal oxides.

The basis for the invention described herein is an improved composition for the treatment of friction pairs, comprising the stable dehydration products of metal and non-metal oxide hydrates selected from the group consisting of MgO, $SiO_2$, $Al_2O_3$, CaO, $Fe_2O_3$, $K_2O$, $Na_2O$. stable dehydration products are formed as nanodispersed oxide structures, which minimize the resistance to displacement and area of contact of surfaces of friction pairs, and converts rubbing friction to rolling friction thereby improving the operation of the treated friction pairs in machines and machine parts.

Appropriate compositions comprising dehydration products of synthetic or naturally occurring minerals or mixtures of minerals can be selected to provide the desired results for the friction pair material to be treated.

Insofar as the inventive compositions can be used with 1 to 10 mass % admixtures, the cost of cleaning the natural raw material to produce the end product is reduced.

In one preferred embodiment of the invention, the composition contains the stable dehydration products of oxide hydrates, which are synthetic.

In another embodiment, the composition contains the stable dehydration products of oxide hydrates in natural minerals or in a mixture of natural minerals, wherein the temperature of dehydration and destruction of the crystal lattice is in the range of 350–900° C.

According to another embodiment of the invention, the composition contains no more than 1–10% by mass of admixtures with the products of dehydration of the natural minerals.

Naturally occurring hydrates of metal and nonmetal oxide hydrates are known to include, for example:

kaolinite—$Al_2O_3*2SiO_2*2H_2O$ (480–590° C.); monothermite—$0,2RO*Al_2O_3*3SiO_2*1,5H_2(+0,5H_2O)$—close to kaolinite and mica (450–550° C.);

pyrophyllite—$Al_2O_3*4SiO_2*H_2O$ (580–800° C.);

muscovite—$K_2O*3Al_2O_3*6SiO_2*2H_2O$ (750–850° C.)—it is the mineral of the mica group;

illite—$K<1Al_2[(Al,Si)_4O_{10}](OH)_2*nH_2O$ (500–650° C.), destruction of the crystal lattice at 840–900° C.—hydromica, it is intermediate formation between of muscovite and kaolinite;

glauconite—$K<1(Fe^{3+}, Fe^{2+}, AL,Mg)_{2-3}[Si_3(Si,Al)O_{10}]*(OH)_2*nH_2O$ (440–510° C.)—it is mineral from ferric hydromica of variable composition, it is found in sedimentary rocks in the form of grain aggregates;

vermiculite—$(Mg,Fe)_3[(Al,Si)_4O10_{10}]*(OH)_2*4H_2O$ (815–850° C.)—it is the mineral from the group of the hydromica with variable chemical composition;

serpentine—$3MgO*2SiO_2*2H_2O$ (720–800° C.)—(chrysolite, antigoryte)—it is natural asbestos mineral;

thepiolite—$Mg_3[Si_4O_{11}]*nH_2O$ (800° C.)—it is product of serpentine changing, moving off the water of constitution takes place with the destruction of the crystal lattice and the transition of thepiolite in amorphous state;

talc—$3MgO*4SiO_2*H_2O$ (800–900° C.), it is formed in the nature, tincal—$Na_2B_4O_7*10H_2O$ ($Na_2O*2B_2O_3*10H_2O$) (350–400° C.)—it is the natural mineral [Gorshkov V. S., Tymashev V. V., Savelev V. G. The methods of the physical-chemical analyze of the astringent substance. —M.: High School, 1981. —335 p.]

Natural minerals such as asbestos, concrete stone, bauxites and kaolin can serve as raw materials to obtain the above-described hydrates.

The synthesized hydrates from the series of MgO—$SiO_2$—$H_2O$, NiO—$SiO_2$—$H_2O$ and MgO—$GeO_2$—$H_2O$ with the serpentine structure, in which it is possible to use the ions $Mn^{2+}$, $Zn^{2+}$, $Co^{2+}$, $Fe^{3+}$, $Cr^{3+}$ and $Ga^{3+}$ as the substitution ions are also known [Della M. Roy, Rustum Roy. Experimental study of the formation and Properties of synthetic sepentines and related layer silicate minerals. —College of Mineral Industries, The Pennsylvania State University, Contribution No.53-9, Oct. 13, 1953].

However, until now, both raw materials and synthetic hydrates were considered primarily as materials for ceramic, building and paper production, and the natural minerals for obtaining materials for the production of aluminum and its compounds.

Applicants' claimed invention differs significantly from the previous uses of synthetic hydrates and naturally occurring minerals in its use of the dehydration products of synthetic oxide hydrates and oxide hydrates in natural minerals for the treatment of friction pairs, which provides reproducibility and considerably enhanced technical-operational properties.

The claimed invention has industrial applications, for example, for the treatment of moving parts in machine construction, for maintaining machines in working order and for repair-restore operations.

USE OF THE INVENTION

The utility of both synthetic and natural mineral hydrates in lubricating compositions was examined. Prior to use, the natural minerals were separated from the admixtures in different degrees. The result of mass spectrometry analyses of the natural mineral admixtures obtained from the different raw minerals is shown in Table 1 and Table 2.

TABLE 1

| ELEMENTS | ATOMIC MASS | ATOMIC % | WEIGHT % |
|---|---|---|---|
| Co | 58.9 | 0.094 | 0.178 |
| Ni | 58.7 | 1.445 | 2.735 |
| Fe | 55.8 | 28.424 | 51.160 |
| Mn | 54.9 | 0.375 | 0.664 |
| Cr | 52.0 | 4.165 | 6.986 |
| V | 50.0 | 0.056 | 0.092 |
| Ti | 47.9 | 2.533 | 3.913 |
| Ca | 28.1 | 1.876 | 1.701 |
| Al | 27.0 | 0.188 | 0.163 |
| Mg | 24.3 | 3.752 | 2.941 |
| O | 16.0 | 57.092 | 29.465 |
| TOTAL: | | 100.00 | 100.00 |

TABLE 2

| ELEMENTS | ATOMIC MASS | ATOMIC % | WEIGHT % |
|---|---|---|---|
| Ni | 58.7 | 0.190 | 0.512 |
| Fe | 55.8 | 2.152 | 5.528 |
| Mn | 54.9 | 0.190 | 0.479 |
| Cr | 52.0 | 0.038 | 0.091 |
| Ti | 47.9 | 0.047 | 0.105 |
| Ca | 40.1 | 7.895 | 14.579 |
| K | 39.1 | 0.028 | 0.051 |
| Cl | 35.4 | 0.028 | 0.046 |
| S | 32.1 | 0.011 | 0.017 |
| P | 31.0 | 0.009 | 0.014 |
| Si | 28.1 | 20.168 | 26.099 |
| Al | 27.03 | 1.412 | 1.756 |
| Mg | 24.3 | 1.896 | 2.121 |
| Na | 23.0 | 0.047 | 0.050 |
| F | 19.0 | 0.019 | 0.017 |
| O | 16.0 | 65.869 | 48.535 |
| TOTAL: | | 100.00 | 100.00 |

As it is seen from Tables 1 and 2 the admixtures of the natural minerals contain the metal ions, which can be present in composition of the strictly serpentine natural structures.

For preparation of the composition for the friction pair treatment the synthesized hydrates and the natural minerals were annealed in a muffle at temperatures of removing structural water. All the examples of the concrete realization and the results of the use of the compositions are grouped in Tables 3–5.

Table 3 contains the list of hydrates, its annealing time and temperature.

After the dehydration, the powder obtained in such a way was mixed with technological medium and was used for the treatment of different units and mechanisms under working conditions.

The main results of the use of different compositions for the friction pair treatment of machines and mechanisms according to the offered technical decision are shown in Tables 4 and 5.

As it is seen from Table 5, the use of the compositions according to the offered technical decision provides to receive the stable results, manifested by hardness and wear resistance increase, friction coefficient decrease, improving of technical-economical characteristics of the machines and mechanisms.

TABLE 3

| Hydrates, mixture of hydrates | Quantity in the mixture (%) | Dehydration temperature (° C.) | Time (hour) | Decrease of weight after dehydration (%) |
|---|---|---|---|---|
| 1. kaolinite with admixture | 8–10 | 480–590 | 1.5–2 | 12–13 |
| 2. serpentine with admixture | 5–7 | 700–800 | 2–2.5 | 12–24 |
| 3. tincal (bura) $Na_2B_4O_7*10H_2O(Na_2O*2B_2O_3*10H_2O)$ | 1–2 | 350–400 | 1.0 | 16–24 |
| 4. muscovite $K_2O*3Al_2O_3*6SiO_2*2H_2O$ | 0.5–2 | 750–850 | 1.0 | 16–20 |
| 5. vermiculite $(MgF)_3[(Al,Si)_4O_{10}*(OH)_2 4H_2O]$ | 1.5–2 | 815–850 | 1.0 | 16–20 |
| 6. synthesized serpentine | 1.5–2 | 700–800 | 2.0 | 12–24 |

TABLE 4

| Testing Group | Technological medium | Number of composition and quantity in admixture (g,l) | | Dispersion (millimicron) |
|---|---|---|---|---|
| 1. cylinder piston group | oil 10W30 | No. 2 | 0.1–0.2 | 10–30 |
| 2. compressor | oil M&B1 | No. 2,6 | 0.1–5.0 | 10–30 |
| 3. bearings | litol-24 | No. 1,6 | 0.1–0.3 | 10–30 |
| 4. reducers | oil MC-20 | No. 2 | 3.0–5.0 | 10–30 |
| 5. crankshaft - shell | cylinder oil | No. 2 | 0.1–0.2 | 10–30 |
| 6. friction pairs of a testing friction machine | oil И-20A | No. 4–6 | 0.1–5.0 | 10–30 |

TABLE 5

| | | Technical - operational characteristics | | | | | |
|---|---|---|---|---|---|---|---|
| Number of testing group | Testing time (hour) | Hardness (HRc) | Friction coefficient | Wear intensity (g/h) $10^{-7}$ | Ru (km) | Oil expense decrease (%) | Vibration decrease (times) |
| 1 | 100 | | | | 2000 | 5–20 | |
| 2 | 100 | | | | | 15–20 | 2–5 |
| 3 | 200 | 270–280 | 0.007–0.008 | | | | |
| 4 | 1000 | | | | | | 2–5 |
| 5 | 3.5 | 390–410 | 0.006–0.008 | | 400 | | |
| 6 | 100 | 390–410 | 0.006–0.008 | 0.2–0.3 | | | |

What is claimed is:

1. A lubricating composition comprising a lubricating medium containing stable dehydration products of metal and non-metal oxide hydrates, wherein said hydrates have a temperature of dehydration and destruction of the crystal lattice in the range of 400° C. to 900° C. and said oxides are selected from the group consisting of MgO, $SiO_2$, $Al_2O_3$, CaO, $Fe_2O_3$, $K_2O$, or $Na_2O$.

2. The composition of claim 1, wherein the metal and nonmetal oxide hydrates are synthetic.

3. The composition of claim 1, wherein the metal and nonmetal oxide hydrates comprise a natural mineral or natural mineral mixture.

4. The composition of claim 3, wherein the dehydration products of the natural mineral or mineral mixture contain between 1 and 10 mass % of admixtures.

5. The composition of claim 3, wherein the natural mineral or minerals are selected from kaolinite, monothermite, pyrophyllite, muscovite, illite, glauconite, vermiculite, serpentine, thepiolite, talc, tincal, asbestos, concrete stone, bauxites, and kaolin.

6. The composition of claim 6, wherein the metal and nonmetal oxide hydrates are selected from the group consisting of MgO—$SiO_2$—$H_2O$, MnO—$SiO_2$—$H_2O$, ZnO—$SiO_2$—$H_2O$, CoO—$SiO_2$—$H_2O$, $Fe_2O3$—$SiO_2$—$H_2O$, $Cr_2O3$—$SiO_2$—$H_2O$, $Ga_2O_3$—$SiO_2$—$H_2O$, NiO—$SiO_2$—$H_2O$, MgO—$GeO_2$—$H_2O$, MnO —$GeO_2$—$H_2O$, ZnO—$GeO_2$—$H_2O$, CoO—$GeO_2$—$H_2O$, $Fe_2O_3$—$GeO_2$—$H_2O$ $Cr_2O_3$—$GeO_2$—$H_2O$ and $Ga_2O_3$—$GeO_2$—$H_2O$ having a serpentine structure.

7. The composition of claim 1, wherein said stable dehydration products have a particle size of 10–30 millimicrons.

8. The composition of claim 1, wherein the lubricating medium is an oil.

9. A method of preparing a lubricant composition of claim 1, which comprises heating a metal and nonmetal oxide hydrate at a temperature of dehydration in the range of 400° C. to 900° C. for a time sufficient to produce a stable dehydration product of said oxide hydrate, and mixing said product with a lubricating medium to produce a lubricant composition, wherein said oxides are selected from the group consisting of MgO, $SiO_2$, $Al_2O_3$, CaO, $Fe_2O_3$, $K_2O$, or $Na_2O$.

10. The method of claim 9, wherein the metal and nonmetal oxide hydrates are synthetic.

11. The method of claim 9, wherein the metal and nonmetal oxide hydrates comprise a natural mineral or natural mineral mixture.

12. The method of claim 11, wherein the dehydration products of the natural mineral or mineral mixture contain between 1 and 10 mass % of admixtures.

13. The method of claim 11, wherein the natural mineral or minerals are selected from the group consisting of kaolinite, monothermite, pyrophyllite, muscovite, illite, glauconite, vermiculite, serpentine, thepiolite, talc, tincal, asbestos, concrete stone, bauxites, and kaolin.

14. The method of claim 10, wherein the metal and nonmetal oxide hydrates are selected from the group consisting of MgO-$SiO_2$—$H_2O$, MnO—$SiO_2$—$H_2O$, ZnO—$SiO_2$-$H_2O$, CoO—$SiO_2$—$H_2O$, $Fe_2O_3$—$SiO_2$—$H_2O$, $Cr_2O_3$—$SiO_2$—$H_2O$, $Ga_2O_3$—$SiO_2$—$H_2O$, NiO—$SiO_2$—$H_2O$, MgO—$GeO_2$—$H_2O$, MnO—$GeO_2$—$H_2O$, ZnO—$GeO_2$—$H_2O$, CoO—$GeO_2$—$H_2O$, Fe2$O_3$—$GeO_2$—$H_2O$ $Cr_2O_3$—$GeO_2$—$H_2O$ and $Ga_2O_3$—$GeO_2$—$H_2O$ having a serpentine structure.

15. The method of claim 9, wherein the lubricating medium is an oil.

16. A method of stably reducing the friction between rubbing surfaces comprising contacting the surfaces with a lubricating composition of claim 1.

* * * * *

UNITED STATES PATENT AND TRADEMARK OFFICE

CERTIFICATE OF CORRECTION

PATENT NO. : 6,423,669 B1 
DATED : July 23, 2002
INVENTOR(S) : Sergei Nikolaevich Alexandrov et al.

It is certified that error appears in the above-identified patent and that said Letters Patent is hereby corrected as shown below:

Column 2,
Line 37, replace "$Fe_2O_2$, $Fe_3O_{4-10}$,$Al_2O_3$," with -- $Fe_2O_2$, $Fe_3O_4$-10, $Al_2O_3$, --

Column 3,
Line 2, replace ". stable" with -- . The stable --

Column 7,
Line 22, replace "The composition of claim 6," with -- The composition of claim 2, --

Signed and Sealed this

Twenty-fifth Day of March, 2003

JAMES E. ROGAN
*Director of the United States Patent and Trademark Office*